US005846655A

United States Patent [19]

Henning et al.

[11] Patent Number: 5,846,655

[45] Date of Patent: Dec. 8, 1998

[54] ELECTRICAL LAYER CONTACT ELEMENT AND METHOD FOR MANUFACTURING SAME

[75] Inventors: Guenther Henning; Ursula Michelsen-Mohammadein; De Marc Vogelaere, all of Berlin; Josef Weiser, Hohenschaeftlarn, all of Germany

[73] Assignee: Siemens Aktiengesellschaft, Munich, Germany

[21] Appl. No.: 698,902

[22] Filed: Aug. 16, 1996

[30] Foreign Application Priority Data

Aug. 18, 1995 [DE] Germany ..... 195 30 512.4

[51] Int. Cl.[6] ..... D02G 3/00

[52] U.S. Cl. ..... 428/378; 428/379; 428/389; 428/375; 252/514; 252/518.1; 252/520.3

[58] Field of Search ..... 200/166; 29/473.3, 29/474.3, 479, 471.3; 204/181.7, 180.2, 80, 294; 252/514, 518.1, 519, 521, 520.3; 428/359, 378, 379, 375

[56] References Cited

U.S. PATENT DOCUMENTS

| | | | |
|---|---|---|---|
| 3,663,777 | 5/1972 | Steinmetz et al. | 200/166 C |
| 3,682,814 | 8/1972 | Gilchrist | 204/181 |
| 3,905,828 | 9/1975 | Barber | 136/6 R |
| 3,971,709 | 7/1976 | Ohsawa et al. | 204/181 |
| 4,879,013 | 11/1989 | Austin | 204/180.2 |
| 4,954,926 | 9/1990 | Pepin | 361/304 |
| 5,051,156 | 9/1991 | Scharifker et al. | 204/80 |
| 5,126,915 | 6/1992 | Pepin et al. | 361/304 |
| 5,167,809 | 12/1992 | Nobe et al. | 252/514 |

*Primary Examiner*—Merrick Dixon
*Attorney, Agent, or Firm*—Hill & Simpson

[57] ABSTRACT

A layer of silver-metal oxide, a layer of gold or a gold alloy and, a layer of rhodium or ruthenium are electrolytically produced on a metal base, preferably in the form of a wire. The gold alloy is partially diffused into the silver-metal oxide layer by an annealing process at a temperature between 300° and 900° C. As a result, a low-impedance and burn-up resistant contact coated element is provided for employment in weak current relays.

8 Claims, 1 Drawing Sheet

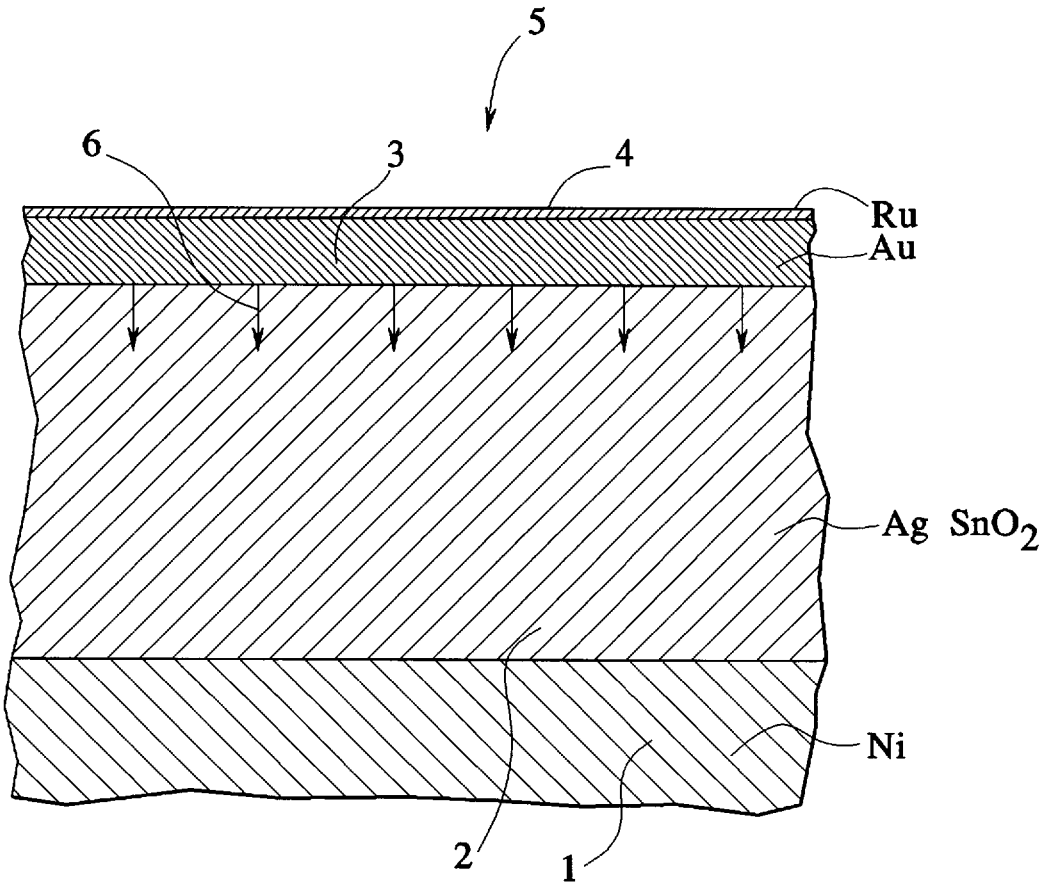
5
6
3
4
Ru
Au
Ag SnO2
Ni
2
1

ELECTRICAL LAYER CONTACT ELEMENT AND METHOD FOR MANUFACTURING SAME

BACKGROUND OF THE INVENTION

1. Field of the Invention

The invention relates to an electrical layer contact element and in particular to an element having a base metal in which a silver-oxide layer and a gold or gold alloy layer are electrolytically produced on the base metal. The invention is also directed to a method for manufacturing such an element.

2. Description of the Prior Art

Layer contact elements of silver alloy and gold alloy are fundamentally known. For example, European Patent No. 160 290 A2 discloses a method for manufacturing a contact material wherein a contact layer of silver or a silver alloy or, alternatively, of palladium or a palladium alloy is electrolytically prepared with a gold layer for corrosion protection and is subsequently malleablized. The gold layer is relatively thin having a thickness that is less than 1 $\mu$m. These layers are not sufficiently resistant to burn-up for various applications. In addition, the costs for the contact are relatively high, especially in applications employing palladium.

German Patent No. 42 17 950 A1 discloses a contact profile with a palladium alloy and a gold alloy deposited on top of the palladium. As stated above, pure palladium layers should be avoided for cost reasons. In addition, the contact profile, consisting of the known alloys including palladium, does not achieve the desired burn-up resistance. Due to its good catalyst properties, palladium could promote the polymerization of plastic vapors in the contact region. This results in an undesirable formation of insulation layers on the contact surfaces ("Brown Powder" effect).

SUMMARY OF THE INVENTION

An object of the present invention is to create a layer contact element for relays or similar switching devices that is highly resistant to burn-up.

A further object of the invention is to create a layer contact element that is cost-effective and is environmentally safe to manufacture and to dispose.

These objects are inventively achieved in a layer contact element having a metal base and a silver-metal oxide layer that is electrolytically produced on the metal base. The silver-metal oxide layer is about 2 to 12 percent by weight dispersant, based upon the weight of the silver-metal oxide layer. The thickness of the silver-metal oxide layer is approximately 20 to 70 $\mu$m.

Electrolytically manufacturing the silver-metal oxide layer is unique from the traditional, powder-metallurgy manufacturing process for silver dispersion layers. The silver-metal oxide layer forms a stem structure that provides the contact element with a high resistance to burn-up. Various metal oxides, for example stannous oxide, titanium oxide or iron oxide may be used as dispersants. Other metals, such as cadmium oxide, can also be employed. However, cadmium oxide is less desirable because of its toxicity. A gold alloy is diffused into the silver dispersion layer so that the material has a low-impedance. The gold alloy layer is approximately 1 $\mu$m to 3 $\mu$m in thickness.

A cover layer of rhodium or ruthenium whose thickness is less than 1 $\mu$m, is produced on the gold alloy layer.

An advantageous method for manufacturing the inventive layer contact elements involves producing a layer of silver-metal oxide onto a metal base. A layer of gold or a gold alloy is subsequently produced on the silver-metal oxide layer. Finally, a third layer of rhodium or ruthenium less than 1 $\mu$m thick is produced on top of the second layer. All layers are produced electrolytically. The contact layers are annealed at a temperature from 300° C. through 900° C., preferably between 350° through 550° C.

BRIEF DESCRIPTION OF THE DRAWINGS

FIG. 1 is a sectional view of a preferred embodiment in which the ratio of layer thicknesses is not drawn to scale.

DETAILED DESCRIPTION OF THE PREFERRED EMBODIMENTS

FIG. 1 shows a preferred embodiment having a metal base (or carrier) 1. The metal base 1 may be a nickel wire having an approximate width of 0.4 mm. A silver dispersion layer 2 with a thickness of 20 $\mu$m to 70 $\mu$m is applied on the metal base 1. The silver dispersion layer 2 consists of a silver matrix and from about 2 to 12 percent by weight dispersant, based upon the weight of the overall composition of the silver dispersion layer 2. The dispersion layer 2 provides a high resistance to burn-up. A gold or gold alloy layer 3 is electrolytically applied over the silver dispersion layer 2. The dispersant being selected from stannous oxide ($SnO_2$) or iron oxide. Illustrative gold alloys include, but are not limited to, alloys of gold and silver such as AuAg8, and alloys of gold and cobalt such as AuCo 0.4. The gold alloy layer 3 has a thickness of 1 to 3 $\mu$m, preferably about 2 $\mu$m. Finally, a cover layer 4 of ruthenium or rhodium is electrolytically applied over the gold alloy layer 3. The cover layer 4 is less than 1 $\mu$m in thickness, preferably about 0.1 $\mu$m thick. The cover layer 4 protects against contact sticking when switching low currents.

The layer contact element 5 is annealed (or thermally treated) at a temperature between 300° C. and 900° C. The thermal treatment diffuses a part of the gold or the gold alloy layer 3 into the silver dispersion layer 2 as indicated by the arrows 6. As a result, the dispersion layer 2 has a low impedance.

The time period in which the thermal treatment is applied to the layer contact element 5 is optimized on a case-by-case basis depending upon the thickness of each of the layers. A time period (or influencing time) may be anywhere from one minute to five hours, given the temperatures between 300° C. and 900° C. A shorter time period is generally applied when the thermal treatment occurs at the higher temperatures.

A reproducible, low-impedance contact coating that is resistant to bum-up and to cold welding is obtained in the described way for applications in weak current relays. This coating is preferably produced on a wire that, as half-finished goods, represents a contact profile. The individual contact pieces are then cut off from the wire for the individual relay contacts and are welded onto the contact carrier 1, for example a sheet metal strip composed of a copper alloy.

The present invention is subject to many variations, modifications and changes in detail. It is intended that all matter described throughout the specification and shown in the accompanying drawings be considered illustrative only. Accordingly, it is intended that the invention be limited only by the spirit and scope of the appended claims.

We claim as our invention:

1. An electrical layer contact element comprising:

a metallic base;

a silver-metal oxide layer, having a thickness of 20 μm to 70 μm electrolytically produced on the base, the silver metal oxide layer comprising a silver matrix and from about 2 to 12 percent by weight dispersant, based upon the weight of the silver-metal oxide layer; and a second layer, of material selected from the group consisting of gold and gold alloys, electrolytically produced on and partially diffused into the silver metal-oxide layer.

2. The layer contact element according to claim 1 wherein the second layer has a thickness between 1 to 3 μm.

3. The layer contact element according to claim 1 further comprising:

a third layer, material selected from the group consisting of rhodium and ruthenium and having a thickness less than 1 μm, electrolytically produced on the second layer.

4. The layer contact element according to claim 1 wherein the silver-metal oxide layer further comprises stannous oxide as a dispersant.

5. The layer contact element according to claim 1 wherein the silver-metal oxide layer further comprises iron oxide as a dispersant.

6. The layer contact element according to claim 1 wherein the layer contact element is a coated wire.

7. A method for manufacturing an electrical layer contact element including a metallic base; the method comprising:

electrolytically producing a silver-metal oxide layer on said base, having a thickness between 20 through 70 μm;

electrolytically producing a second layer on the silver-metal oxide layer of material selected from the group consisting of gold and gold alloys, and having a thickness of 1 through 3 μm;

electrolytically producing a third layer on the second layer of material selected from the group consisting of rhodium and ruthenium and having a thickness less than 1 μm, on the second layer; and annealing the silver-metal oxide the second, and the third layers.

8. The method according to claim 7, wherein the step of annealing the layers comprises annealing at a temperature between 300° and 900° C.

* * * * *